US006798142B2

(12) United States Patent
Eguchi

(10) Patent No.: US 6,798,142 B2
(45) Date of Patent: Sep. 28, 2004

(54) FLASH EMITTING DEVICE AND RADIANT HEATING APPARATUS

(75) Inventor: Hiromasa Eguchi, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/326,144

(22) Filed: Dec. 23, 2002

(65) Prior Publication Data

US 2003/0132692 A1 Jul. 17, 2003

(30) Foreign Application Priority Data

Dec. 25, 2001 (JP) ..... 2001-391406

(51) Int. Cl.[7] ..... H01J 7/24

(52) U.S. Cl. ..... 315/115; 219/411; 219/412; 392/411; 392/418; 315/241 R

(58) Field of Search ..... 315/46, 115, 152, 315/156, 158, 227 R, 241 R, 242–244, 241 P; 219/395, 402, 405, 411–412; 392/416, 418, 411, 422

(56) References Cited

U.S. PATENT DOCUMENTS 3,862,397 A * 1/1975 Anderson et al. ..... 219/405
4,041,278 A * 8/1977 Boah ..... 219/411
4,433,232 A * 2/1984 Tachikawa et al. ..... 219/502
4,493,977 A * 1/1985 Arai et al. ..... 219/411
4,567,352 A * 1/1986 Mimura et al. ..... 219/405
4,649,261 A * 3/1987 Sheets ..... 219/390
4,698,486 A * 10/1987 Sheets ..... 219/390
4,859,832 A * 8/1989 Uehara et al. ..... 219/411
6,476,910 B1 11/2002 Hermes ..... 356/336
6,480,303 B1 11/2002 Kawasaki et al. ..... 358/474
6,660,973 B2 * 12/2003 Hata ..... 219/390
2002/0084261 A1 * 7/2002 Yamazaki ..... 219/390

FOREIGN PATENT DOCUMENTS

JP 2002-57301 2/2002

* cited by examiner

*Primary Examiner*—Thuy Vinh Tran
(74) *Attorney, Agent, or Firm*—Rader, Fishman & Grauer PLLC

(57) ABSTRACT

In a flash emitting device, a flash from the plurality of flash discharge lamps is emitted on a work piece. The flash emitting device has a plurality of flash discharge lamps arranged in parallel including side flash discharge lamps located on sides of the flash emitting device and center flash discharge lamps located at the center portion of the flash emitting device, side main condensers, each of which is connected to one of the side flash discharge lamps, and center main condensers, each of which is connected to one of the center flash discharge lamps, wherein a voltage to which the side main condensers is charged is higher than that to which the center main condensers are charged.

30 Claims, 8 Drawing Sheets

FLASH EMITTING DEVICE AND RADIANT HEATING APPARATUS

BACKGROUND OF THE INVENTION

1. Technical Field of the Invention

The present invention relates to a flash emitting device that is used, as a heat source, for heat-treating a workpiece such as one or more semiconductor wafers, semiconductor boards and liquid crystal boards, and to a radiant heating apparatus having a flash emitting device.

2. Description of Related Art

In recent years, since it is required that a surface layer portion of a workpiece such as a semiconductor wafer be heated at a desired temperature for a very shot time, it has been examined whether a flash discharge apparatus having a flash discharge lamp can be used as a heat source.

On the other hand, semiconductor wafers having a 100 to 200 mm diameter are popular. Further, semiconductor wafers having a larger diameter such as a 300 mm diameter wafer have been used. It is difficult to uniformly heat such a large semiconductor wafer at a high temperature for a very short time by the flash discharge lamp.

Accordingly, to put such a radiant heating apparatus having a flash discharge lamp into practice, as a heat source, flash emitting devices having a plurality of flash discharge lamps that are in parallel arranged at even intervals and a common reflector of all the flash discharge lamps, have been developed.

However, in such a radiant heating apparatus having the flash emitting device, flash lights emitted from the flash discharge lamps are overlaid on a workpiece such as a semiconductor wafer. Actually, the intensity of the overlaid flash lights emitted on a side portion of the semiconductor wafer is lower than that of the light emitted on the center portion of the semiconductor wafer. As a result, since the intensity of the flash light is not enough to heat the entire surface of the workpiece, the entire surface of the workpiece is not uniformly heated.

SUMMARY OF THE PRESENT INVENTION

It is an object of the present invention to uniformly heat a workpiece such as one or more semiconductor wafers.

It is another object of the present invention to provide a flash emitting device which is capable of uniformly heating a workpiece such as one or more semiconductor wafers with the relatively small number of flash discharge lamps.

It is a further object of the present invention to provide a radiant heating apparatus having a flash emitting device which is capable of uniformly heating a workpiece such as one or more semiconductor wafers with a relatively small number of flash discharge lamps.

The present invention provides a flash emitting device having a plurality of flash discharge lamps arranged in parallel, in which a flash from the plurality of flash discharge lamps is emitted on a workpiece. The flash emitting device comprises main condensers each of which connected to one of the plurality of flash discharge lamps, wherein among the plurality of flash discharge lamps, at least one flash discharge lamp located on at least one side of the flash emitting device emit light with higher intensity than that of the plurality of flash discharge lamps other than said at least one flash discharge lamp.

The present invention further provides a flash emitting device in which a flash from the plurality of flash discharge lamps is emitted on a work piece. The flash emitting device comprises a plurality of flash discharge lamps arranged in parallel wherein at least one of the plurality of flash discharge lamps is a side flash discharge lamp located on at least one side of the flash emitting device and at least one of the plurality of flash discharge lamps is a center flash discharge lamp located on at least a center of the flash emitting device, at least one side main condenser, each of which is connected to one of the at least one side flash discharge lamps; at least one center main condenser, each of which is connected to one of the at least one center flash discharge lamps; wherein a voltage to which the at least one side main condenser is charged is higher than the voltage to which said at least one center main condenser are is charged.

The flash emitting device may include a first direct current power source for supplying power to the at least one center main condenser and a second direct current power source for supplying power to the at least one center main condenser.

The flash emitting device may further include a charge time controller in which the voltage to which the at least one center main condenser is charged is controlled so as to be lower than that to which the at least one side main condenser is charged, by charging the at least one center main condenser for a shorter time than that for the at least one side main condenser.

The flash emitting device may furthermore include a discharge controller in which the voltage to which the at least one center main condenser is charged is controlled to be lower than the voltage which the at least one side main condenser is charged, by discharging charges accumulated in the at least one center main condenser.

The flash emitting device may further include a chamber in which the workpiece is placed and flash lights from the plurality of the at least one side flash discharge lamp and the at least one center flash discharge lamp are emitted onto the workpiece.

The workpiece may be one or more semiconductor wafers.

The present invention furthermore provides a radiant heating apparatus comprising a flash emitting device having a plurality of flash discharge lamps arranged in parallel, in which a flash from the plurality of flash discharge lamps is emitted onto a workpiece, the flash emitting device comprising; a plurality of main condensers corresponding to the plurality of flash discharge lamps, wherein at least one of the plurality of flash discharge lamps, is located on at least one side of the flash emitting device and emits light with a higher intensity than light emitted from the plurality of flash discharge lamps located on another side of the flash emitting device.

According to the present invention, in the flash emitting device, the capacity of all the main condensers corresponding to the plurality of flash discharge lamps respectively is substantially the same.

Further, the voltage to which each of the side main condensers is charged is higher than any one of the center main condensers. Therefore, the full-width half maximum (FWHM) of the waveform of flash light emitted from each of the side flash discharge lamps agrees with the full-width half maximum (FWHM) of the waveform of flash light emitted from each of the center flash discharge lamps. Furthermore, a peak reaching time of the waveform of the flash light emitted from each of the side flash discharge flash lamps does not differ from that of the waveform of the flash light emitted from each of the center flash discharge lamps. ("peak reaching time" means a time period for light emitting energy to reach the peak energy level.)

Since the emitting light energy of the flash light emitted from each of the side flash discharge lamps is higher than that of the flash light emitted from each of the center flash discharge lamps, it is possible to make the intensity of light emitted on the side area of the workpiece substantially the same as that of light emitted on the center area of the workpiece.

BRIEF DESCRIPTION OF THE DRAWINGS

The present invention will now be described by way of example with reference to the following figures in which.

DETAILED DESCRIPTION OF THE PREFERRED EMBODIMENTS

Description of embodiments according to the present invention will be given referring to FIGS. 1 to 4.

[Embodiment 1]

Figure 1:
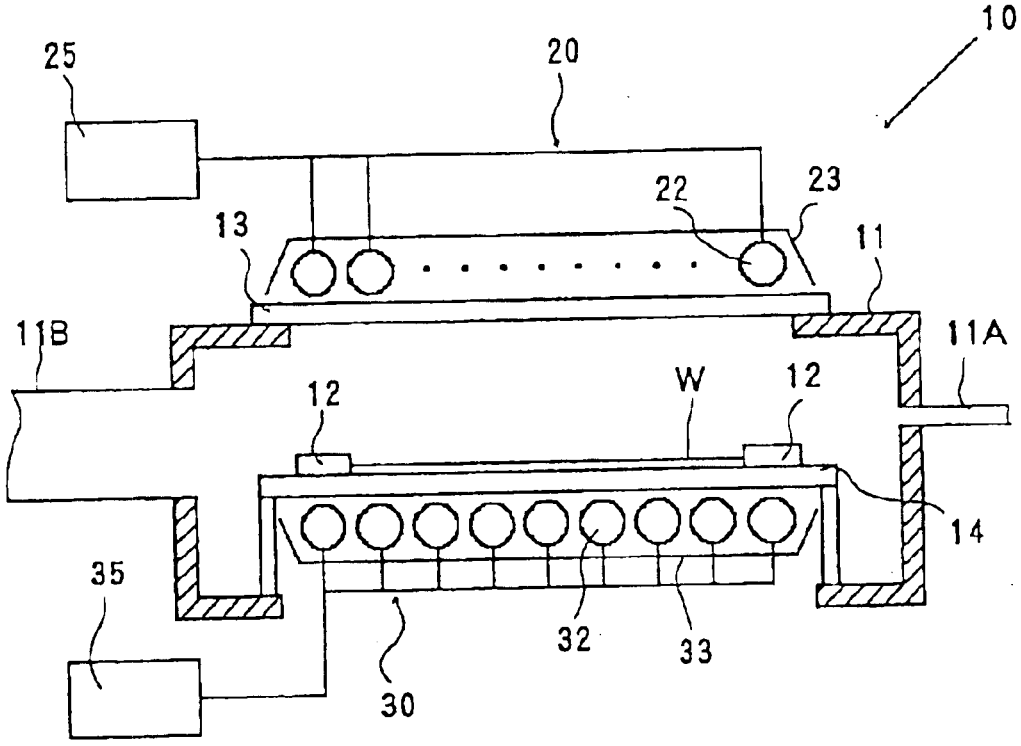
FIG. 1 is a sectional view of a radiant heating apparatus according to the present invention.

FIG. 1 is a sectional view of a radiant heating apparatus according to the present invention.

The radiant heating apparatus 10 for heat-treating a workpiece such as a semiconductor wafer denoted by W in FIG. 1 comprises a chamber 11 made of quartz glass, an inlet 11A for introducing gas into the chamber 11, and supporting portions 12, provided in the chamber 11, for supporting the semiconductor wafer.

The chamber 11 has a semiconductor transporting path 11B. A first quartz window 13 is provided on an upper side of the chamber 11. The first quartz window 13 covered by a quartz plan board (shown upward in FIG. 1). Further, a second quartz window 14 is provided on a bottom portion of the chamber 11 as shown in FIG. 1.

A pre-heating device 30 is provided below the second quartz window 14 (as shown in FIG. 1). A flash emitting device 20 is provided as a heat source above the first quartz window 13 (as shown in FIG. 1). The flash emitting device will be explained later.

In this embodiment, the pre-heating device 30 has a plurality of a rod-shaped halogen lamps 32 (nine lamps in this embodiment), a common reflector 33 of all the halogen lamps 32 (flash discharge lamps), and a halogen lamp turning-on circuit 35 for controlling each of the halogen lamps 32. The flash discharge lamps are arranged at even intervals along with the second quartz window 14.

In the radiant heating apparatus, for example, right after the workpiece is pre-heated up to a desired temperature at which heat diffusion of impurities does not cause, by preliminarily turning on the halogen lamps 32 of the pre-heating device 30, the plurality of the halogen lamps 32 are turned off and the flash emitting device 20 emits flash light to heat-treat the workpiece.

The flash emitting device 20 has a plurality of rod-shaped flash discharge lamps 22 (twenty one (21) discharge lamps in this embodiment.), a common reflector 23 of all the flash lamps 22 and a flash discharge lamp turning-on circuit 25 for controlling each of the flash discharge lamps 22. The flash discharge lamps 22 are in parallel arranged at even intervals along with the first quartz window 13.

For example, the flash discharge lamps 22 used for the present invention have xenon gas therein and are sealed at both ends thereof. The flash discharge lamps 22 have a rod-shaped discharge container made of quartz glass, a trigger electrode 28 extending in the axis and provided along the outer surface of the discharge container, and an anode and a cathode that face each other in the discharge space.

Figure 2:
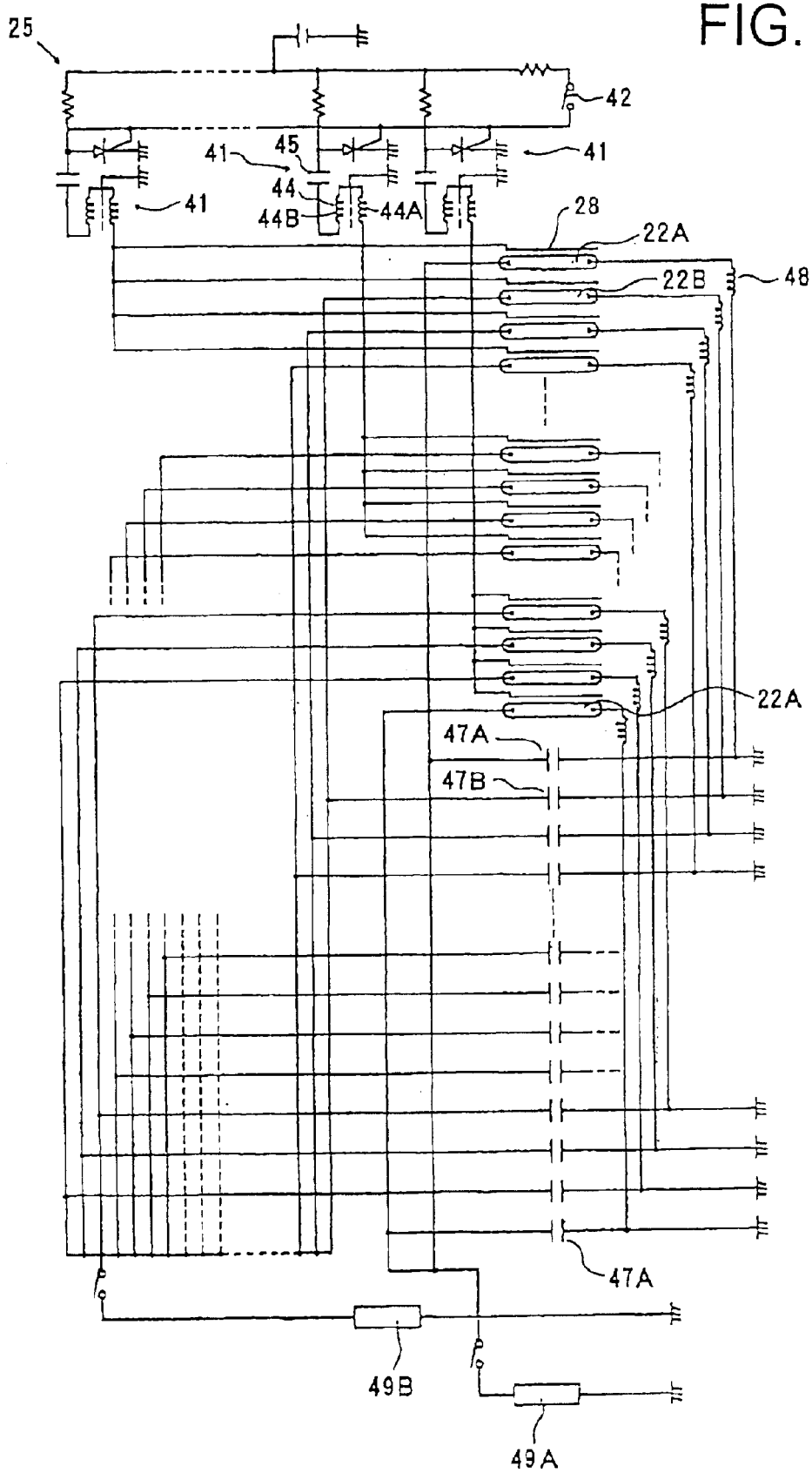
FIG. 2 shows a flash discharge lamp turning-on circuit for controlling flash discharge lamps according to the present invention.

FIG. 2 shows the flash discharge lamp turning-on circuit 25 for controlling each of the flash discharge lamps 22 according to the present invention.

The flash discharge lamp turning-on circuit 25 has a plurality of flash emitting units, wherein each of the flash discharge lamps of each of the flash emitting units is connected to a common trigger circuit 41 (common to all the flash discharge lamps of the unit) via a trigger electrode 28 of each of the flash discharge lamps 22. Each of the flash emitting units has four (4) lamps in this embodiment. The flash emitting units are triggered by a switch 42 which forms a common driving signal generator.

Each of the trigger circuits 41 has a transformer 44 comprising a secondary coil 44A connected to the trigger electrode 28 of a corresponding flash discharge lamps 22 and a primary coil 44B connected to a condenser 45 for a trigger signal. Based on a light emitting command signal, the switch 42 is closed whereby the switch 42 functions as the driving signal generator and a driving signal is generated. Since the switch 42 is common to all the trigger circuit 41, it is possible to send a driving signal(s) to all the trigger circuits 41 simultaneously.

Each of the flash discharge lamps 22 of the flash emitting device 20 is in parallel connected to a corresponding main condenser for supplying light-emitting energy respectively. A waveform rectifying coil 48 is connected to each of circuits connecting each of the flash discharge lamps 22 to the corresponding main condenser Among the plurality of flash discharge lamps arranged in parallel, flash discharge lamps 22A located on both sides of the flash emitting device 20 as shown in FIG. 2 are side flash discharge lamps, each of which is connected to a corresponding side main condenser 47A. There can be more than one side flash discharge lamps on each side. Each of the side main condensers 47A is connected to a second direct current power source 49A which is common to all the side main condensers 47A. Among the plurality of flash discharge lamps arranged in parallel, center flash discharge lamps 22B located on the center portion of the flash emitting device 20 (or between the side flash discharge lamps 22A) as shown in FIG. 2 are center flash discharge lamps, each of which is connected to a corresponding side main condensers 47B. Each of the center main condensers 47B is connected to a first direct current power source 49B which is common to all the center main condensers 47B. (One side flash discharge lamp 47A is located on each side.)

In the example shown in FIG. 2, all the flash discharge lamps are the center flash discharge lamps 22B except for the two side flash discharge lamps 47A. Further, all the main condensers are the center main condensers 47B except for the two side main condensers 47A corresponding to the side flash discharge lamps 22A.

The side main condensers 47A and the center main condensers 47B (hereinafter referred to as the main condensers) may be a film condenser for charging and discharging.

Each of the main condensers for the flash emitting device 20 requires substantially the same electrical capacity.

To obtain all the main condensers having substantially the same electrical capacity, preferably these condensers are selected from ones, with the same specification, manufactured in the same manufacturing process. These condensers may have electrical capacity with only ±1% dispersion.

By using the main condensers having substantially the same capacity, the full-width half-maximum (FWHM) of the waveform of flash lights emitted from each of the flash discharge lamps 22 is necessarily uniform. Further, since a peak reaching time of flash light emitted from each of the flash discharge lamps 22 is uniform, it is possible to maintain the entire surface of the workpiece to be treated such as a semiconductor wafer in a uniform temperature rising state.

A voltage to which the center main condensers 47A are charged by supplying power by the second direct current power source 49A (whose output voltage is higher than that of the first direct current power source 49B) is higher than that to which the center main condenser 47B are charged by supplying power by the second direct current power source 49B.

Preferably, the charged voltage of the side main condensers 47A is 1.05 to 1.5 times as high as that of the center main condensers 47B.

Since the voltage to which the side main condensers 47A are charged is higher than that to which the center main condensers 47B are charged, light emitting energy emitted from the side flash discharge lamps 22A is higher than that of the center flash discharge lamps 22B.

When the flash emitting device 20 receives a light emitting command signal, the switch 42 is closed so that the circuit is in continuity, and then a driving signal is sent and charges charged to the trigger condenser 45 are discharged. Then, in the secondary coil 44A of the transformer 44, a high voltage for a trigger is generated. The generated high voltage is impressed to the trigger electrode 28 and then the flash discharge lamps 22 are driven.

In such a manner, the plurality of the flash discharge lamps 22 are simultaneously driven based on the driving signal(s) sent by the driving signal generator, and then flash lights emitted from the flash discharge lamps 22 are overlaid on the surface of a workpiece such as a semiconductor wafer.

In the radiant heating apparatus described above, the flash emitting device 20 having the flash discharge lamps 22 that correspond to the area (size) of workpiece such as a semiconductor wafer is provided as a heat source. The capacity of the main condensers, each of which is connected to one of the flash discharge lamps 22, is substantially the same. Further, a voltage to which the side main condensers 47A (corresponding to the side flash discharge lamps 22A) are charged is higher than that to which any one of the center main condensers 47B is charged. Therefore, the full-width half-maximum (FWHM) of the waveform of flash light emitted from each of the side flash discharge lamps 22A which is driven simultaneously is substantially the same as that of the waveform of flash light emitted from each of the center flash discharge lamps 22B. Furthermore, the peak reaching time of the waveform of the flash light emitted from each of the side flash discharge lamps 22A does not differ from that of the waveform of the flash light emitted from each of the center flash discharge lamps 22B, and light emitting energy of the flash light from each of the side flash discharge lamps 22B is higher than that of each of the center flash discharge lamps 22A.

As a result, it is possible to make the intensity of the flash light emitted on the side of the workpiece from the side flash discharge lamps 22A approximately the same as that of flash light emitted on the center portion of the workpiece from the center flash discharge lamps 22B. Therefore, it is possible to highly uniformly heat the surface of the semiconductor wafer by the relatively small number of flash discharge lamps even though the semiconductor has a large surface.

In the radiant heating apparatus, 21 flash discharge lamps 22 are provided. Each of flash discharge lamps 22 has a discharge container with a 10.5 mm outer diameter and an 8.5 inner diameter. A trigger electrode having a 280 mm electrode distance is provided on an outer surface of the discharge container and is made of a nickel wire with a 1.0 mm diameter. Among the twenty one flash discharge lamps, 3 flash discharge lamps are located on each side of the flash emitting device (the total number of the side flash discharge lamps is six (6)). These six (6) discharge lamps are hereinafter referred to the six (6) side flash discharge lamps.

A voltage to which each of the main condensers corresponding to the six (6) flash discharge lamps is charged is set to be 1.2 times as high as that to which the other main condensers are charged. By using the radiant heating apparatus 10 having the flash emitting device 20 as a heat source, it is possible to highly uniformly heat-treat the surface of the semiconductor wafer even though the semiconductor wafer has a large surface, for example, having a 200 mm diameter semiconductor wafer.

[Embodiment 2]

Figure 3:
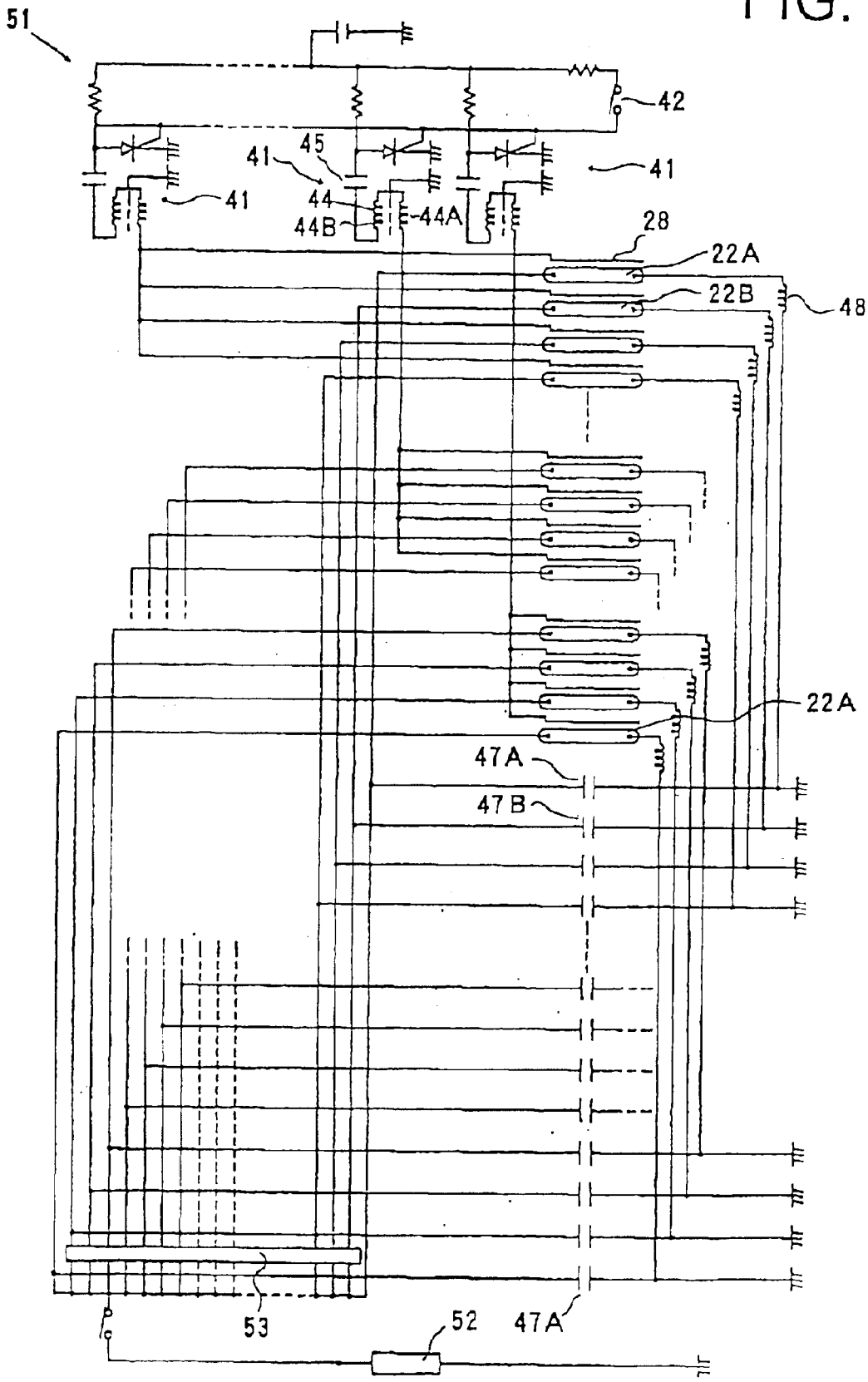
FIG. 3 shows another example of a flash discharge lamp turning-on circuit for controlling flash discharge lamps according to the present invention.

FIG. 3 shows another example of a flash discharge lamp turning-on circuit 51 for controlling a plurality of flash discharge lamps according to the present invention.

In this embodiment, the structure of a flash emitting device in this embodiment is the same as that of the first embodiment except for a flash discharge turning-on circuit 51, in which a charge time controller is provided. Each of the charge time controller comprises a controlling circuit 53 that controls a voltage (to which a corresponding center main condenser 47B is charged) to be lower than that of side main condensers 47A by charging the center main condenser 47A for shorter time than that for the side main condensers 47B.

In the flash discharge lamp turning-on circuit 51, each of the controlling circuits 53 is connected to a common direct current power source 52 that supplies power to the main condensers (the side main condensers 47A and the center main condensers 47B), and the center condensers 47B.

In the example shown in FIG. 3, among the plurality of flash discharge lamps, one side flash discharge lamp is located on each side of the flash emitting device 20. Therefore, the total number of the side flash discharge lamps 22B is 2. All the flash discharge lamps are the center flash discharge lamps 22B except for the two side flash discharge lamps 22A. Further, all the main condensers are the center main condensers 47B except for the two side main condensers 47A corresponding to the side flash discharge lamps 22A.

In the flash emitting device, the side main condensers 47A and the center main condensers 47B are connected to the common direct current power source 52. Although the capacity of these main condensers are substantially the same, it is possible for the charge time controller to make time for charging the center main condensers 47B shorter than that for charging the side main condensers 47A since the center condensers 47B are connected to the direct current power source 52 via the charge time controller. Thus, it is possible to make the voltage to which the side main condensers 47A are charged higher than that to which the center main condensers 47B are charged.

Therefore, it is possible to make the intensity of the flash light emitted on the side of the workpiece approximately the same as that of the flash light emitted on the center portion of the workpiece. Therefore, it is possible to highly uniformly heat the surface of the workpiece by the relatively small number of flash discharge lamps even though the workpiece has a large surface.

[Embodiment 3]

Figure 4:
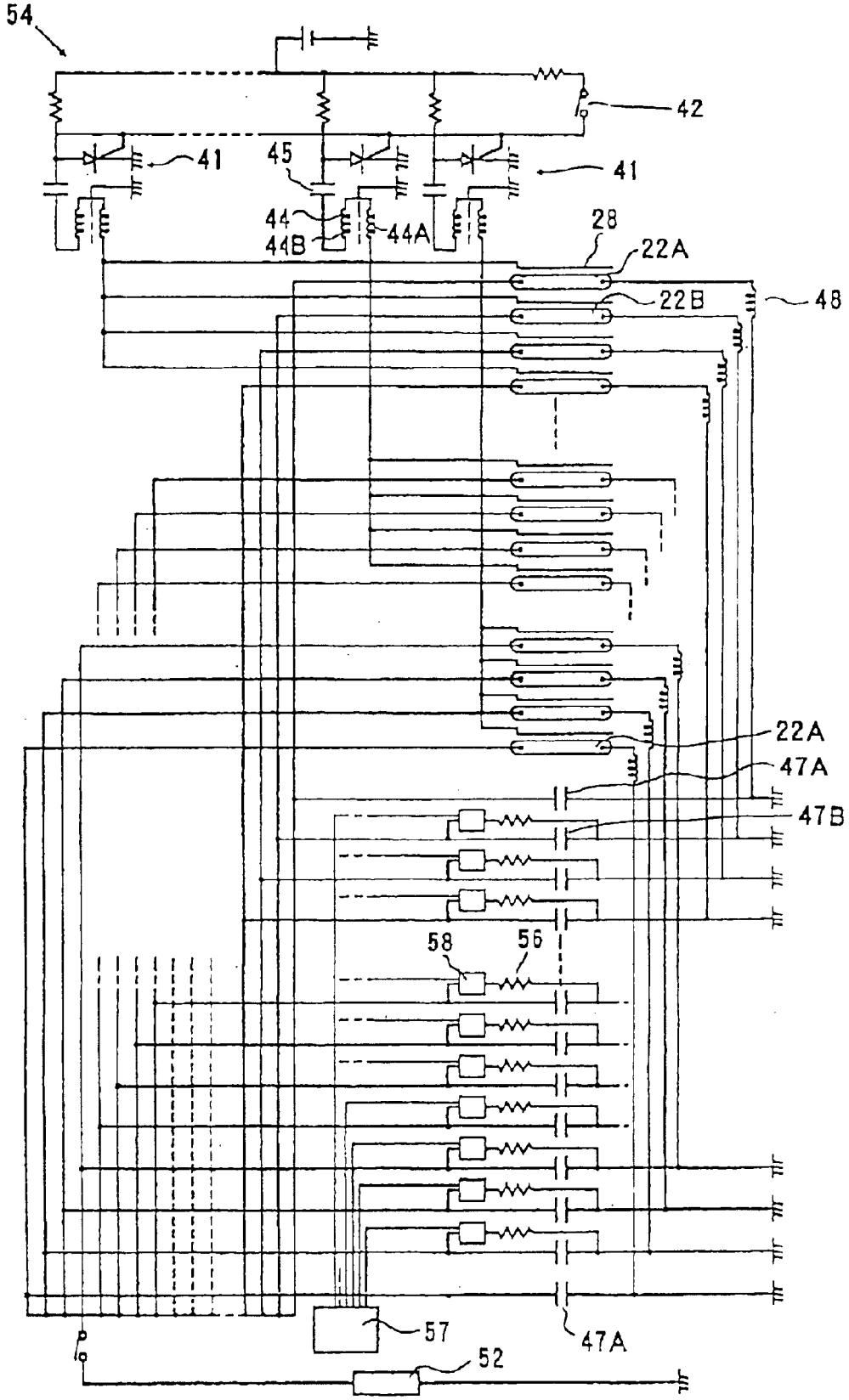
FIG. 4 shows still another example of a flash discharge lamp turning-on circuit for controlling flash discharge lamps according to the present invention.

FIG. 4 shows still another example of a flash discharge lamp turning-on circuit for controlling a plurality of flash discharge lamps according to the present invention.

In this embodiment, the structure of a flash emitting device is the same as that of the first embodiment except for a flash discharge lamp turning-on circuit 54 having a discharge controller that controls voltage (to which center main condensers 47B are charged) so as to be lower than that to which side main condensers 47A are charged, by discharging charges charged to each of the center main condensers 47B.

In the flash discharge lamp turning-on circuit 54, each of the discharge controllers comprises discharge resistance 56, which is in parallel connected to one of the center main condensers 47B, and voltage detecting devices 58, which is in series connected to the corresponding voltage detecting device 58.

As shown in FIG. 4, a common direct current power source 52 supplies power to all the main condensers (the side main condensers 47A and the center main condensers 47B. A controller 57 controls each of the voltage detecting devices 58. The controller 57 is common to the plurality of the voltage detecting devices 58.

In the example shown in FIG. 4, among the plurality of flash discharge lamps, one flash discharge lamp is located on each side of the flash emitting device 20. Therefore, the number of the flash discharge lamps is 2. All the flash discharge lamps are the center flash discharge lamps 22B except for the two side flash discharge lamps 22A. Further, all the main condensers are the center main condensers 47B except for the two side main condensers 47A corresponding to the side flash discharge lamps 22A.

In the flash emitting device, the side main condensers 47A and the center main condensers 47B are connected to the common direct current power source 52. Although the capacity of these main condensers are substantially the same, since each discharge controller is connected to the corresponding center condensers 47B it is possible to discharge charges accumulated in the center main condensers 47B by the discharge controller. Therefore, it is possible to make voltage to which the side main condensers 47A are charged higher than that to which the center main condensers 47B are charged.

Therefore, it is possible to make the intensity of the flash light emitted on the side(s) of the workpiece approximately the same as that emitted on the center portion of the workpiece. Therefore, it is possible to highly uniformly heat the surface of the workpiece by the relatively small number of flash discharge lamps despite a large workpiece.

The present invention is not limited to the embodiments described above. It is possible to modify these examples. For example, the number of side flash discharge lamps arranged in parallel may be selected based on the area of a workpiece to be heated. The number of the center flash discharge lamps may be one or more. The number of the side flash discharge lamps may be one (1), or more. In those cases, each of the flash discharge lamps is connected to one of main condensers. In case that a plurality of side flash discharge lamps are placed on both side, the number of the flash discharge lamps is preferably the same on each side. Further, a workpiece may be more than one semiconductor wafers.

Further, the flash emitting device is applied to the radiant heating apparatus that heat-treats the workpiece, but the application of the flash emitting device is not limited to the radiant heating apparatus.

Description of experiments to confirm the effects of the present invention will be given below.

[Experiment 1]

Flash discharge lamps used in this experiment have a discharge container with a 10.5 mm outer diameter and an 8.5 inner diameter, and a trigger electrode having a 280 mm electrode distance, provided on the outer surface of the discharge container and made of a nickel wire with a 1.0 mm diameter. As shown in Table 1 below, as a standard condition, a light turning-on condition (a) was used. In a light turning-on condition (b), voltage to which main condensers were charged was higher than that in the light turning-on condition (a). In a light turning-on condition (c), the electrical capacity is larger than that of the light turning condition (a). In each of the light turning-on conditions, the waveform of light emitted from the flash discharge lamps was measured by detecting current value.

Figure 5:
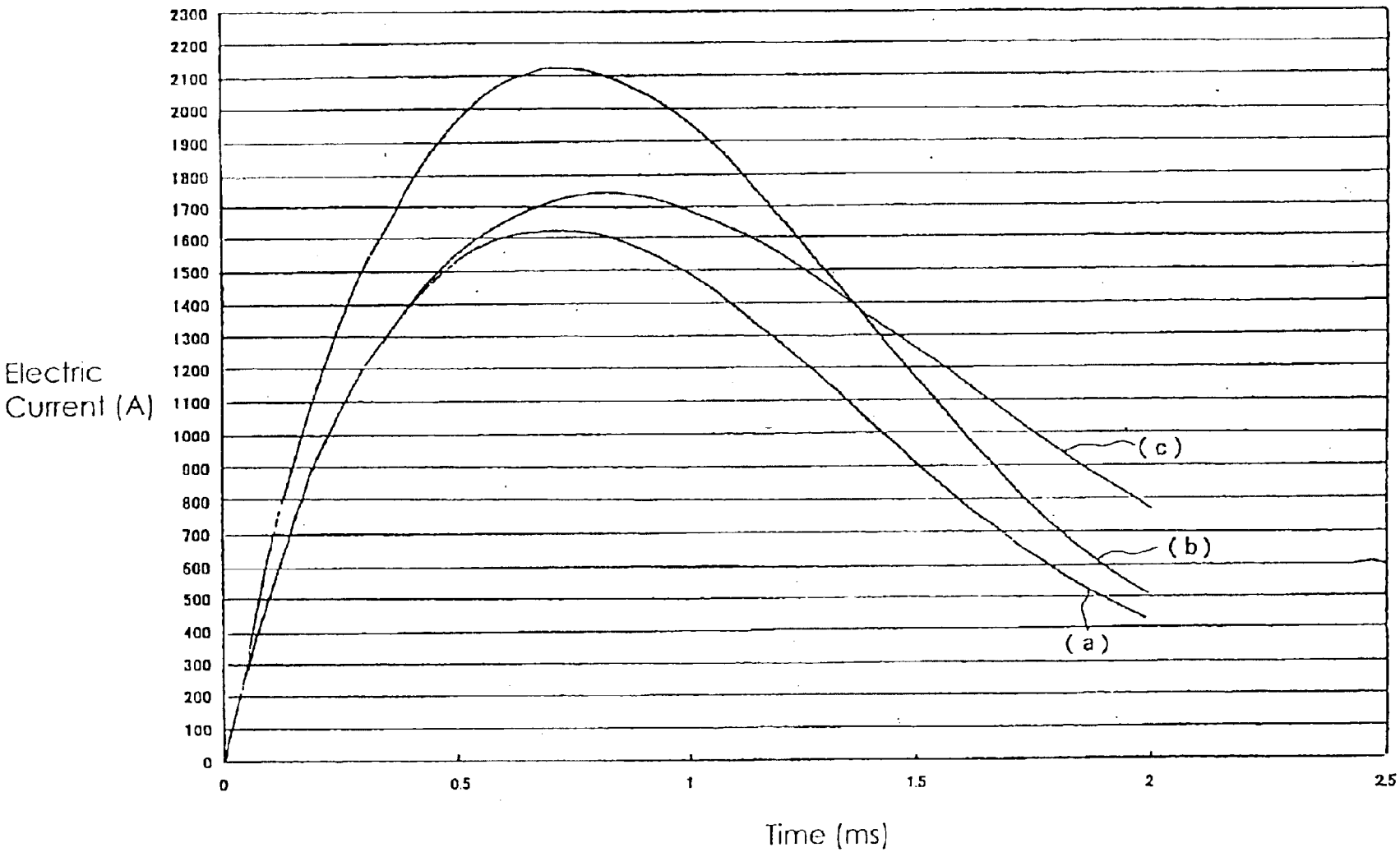
FIG. 5 is a graph showing wave forms of flash according to the first embodiment.

The results are shown in FIG. 5. In FIG. 5, the result of the light turning-on condition (a) is shown as a curved line (a). The result of the light turning-on condition (b) is shown as a curved line (b). The result of the light turning-on condition (c) is shown as a curved line (c).

TABLE 1

| | The electrical capacity of main condensers ($\mu$F) | Voltage charged in the main condensers (V) |
|---|---|---|
| Light turning on condition (a) | 1200 | 2500 |
| Light turning on condition (b) | 1200 | 3000 |
| Light turning on condition (c) | 1680 | 2500 |

From these results, to increase the light emitting energy of the flash lamp, there are the following two ways:

(1) Increasing the electrical capacity of the main condensers; and (2) Increasing the voltage to which the main condensers are charged.

However, where the voltage to which the main condensers were charged was increased, FWHM of the flash light waveform did not change and further, the peak reaching time did not differ from each other, and furthermore the light emitting energy thereof became high.

On the other hand, in the case that the capacity was increased, the light emitting energy was increased but the FWHW of the flash light waveform was increased and further, it took more time to reach the peak.

Therefore, to increase the light emitting energy of the flash discharge lamps, it is effective to increase the voltage to which the main condensers are charged.

[Experiment 2]

In the second experiment, an experimental radiant heating apparatus as shown in FIG. 1, having a flash emitting apparatus comprising twenty one (21) flash discharge lamps as a heat source was assembled, using a flash discharge lamp turning-on circuit as shown in FIG. 2.

In the experimental radiant heating apparatus, each of flash discharge lamps used in this experiment has a discharge container with a 10.5 mm outer diameter and an 8.5 inner diameter, and a trigger electrode having a 200 mm electrode distance, provided on an outer surface of the discharge container and made of a nickel wire with a 1.0 mm diameter. The twenty one flash discharge lamps were selected from the same production lot. The main condensers were also selected from the same production lot.

In the experimental radiant heating apparatus, as a standard light turning-on condition, a light turning-condition (1) shown in Table 2 was used; In a light turning-on condition (2), a voltage to which each of the main condensers corresponding to 6 flash discharge lamps located on both sides of the flash emitting device (hereinafter referred to 6 side flash discharge lamps) was charged was set to be 1.2 times as high as that to which the other main condensers were charged. In a light turning-on condition (3), voltage to which each of the main condensers corresponding to the 6 side flash discharge lamps was charged was set to be 1.4 times as high as that to which the other main condensers were charged. In a light turning-on condition (4), voltage to which each of the main condensers corresponding to the 6 side flash discharge lamps was charged was set to be 1.67 times as high as that to which the other main condensers were charged.

In each of the light turning-on conditions, the waveforms of light emitted on the center and side portions (as shown in Table 2) of a 200 mm diameter semiconductor wafer was measured. The results are shown in FIG. 6.

Figure 6:
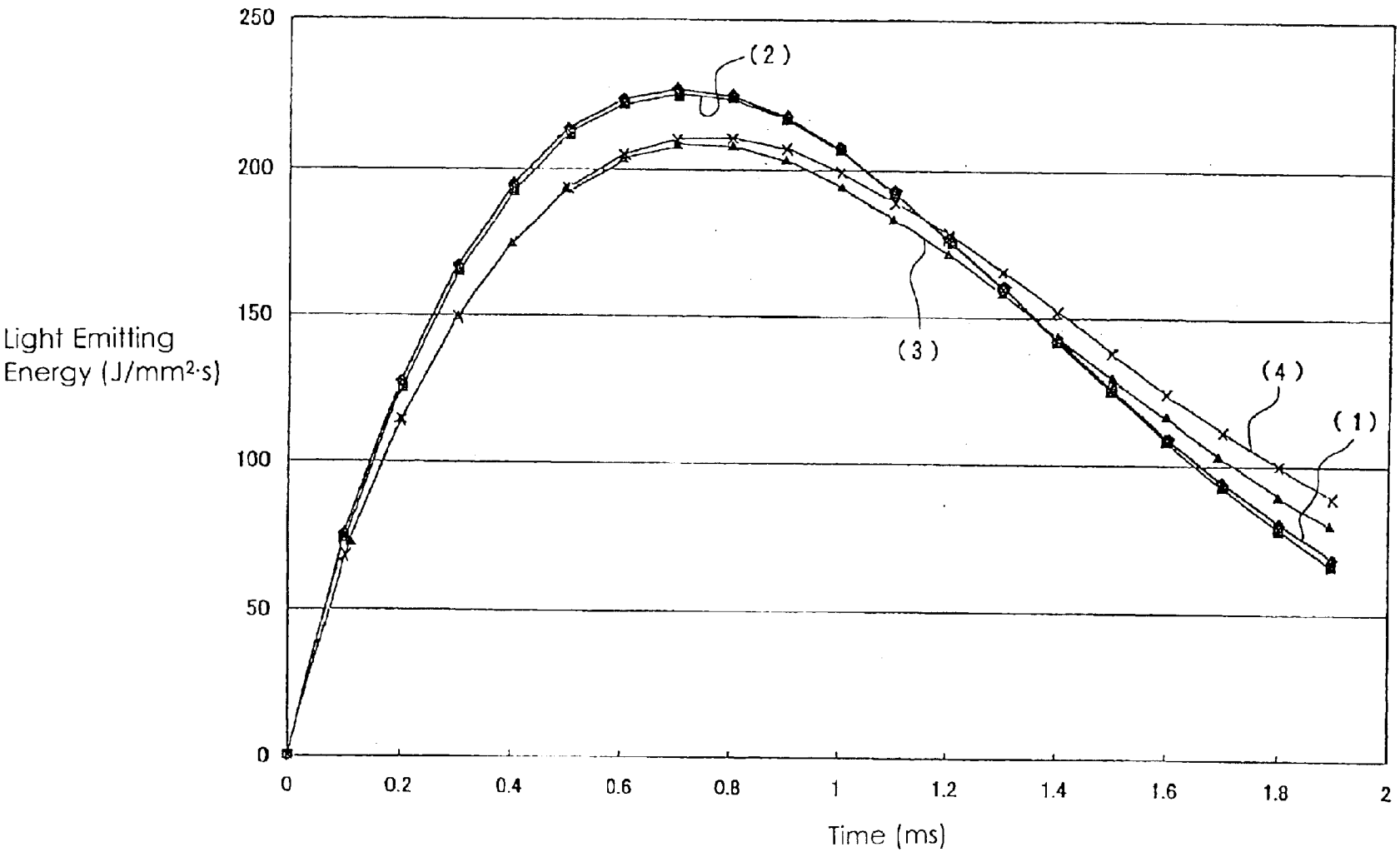
FIG. 6 is a graph showing wave forms emitted from a flash emitting device of an experimental radiant heating apparatus according to the second embodiment.

In FIG. 6, the result of the light turning-on condition (1) is shown as a curved line (1). The result of the light turning-on condition (2) is shown as a curved line (2). The result of the light turning-on condition (3) is shown as a curved line (3). The result of the light turning-on condition (4) is shown as a curved line (4).

TABLE 2

| | The capacity of main condensers ($\mu$F) | Voltage to which the main condensers (V) were charged | Measured Portion |
|---|---|---|---|
| Light turning on condition (1) | 1200 | 2500 | Center portion |
| Light rurning on condition (2) | 1200 | 3000 | Side portion |
| Light turning on condition (3) | 1680 | 2500 | Side portion |
| Light turning on condition (4) | 2004 | 2500 | Side portion |

In the Table 2, the side portion refers to a portion located at a distance 100 mm from the center of the semiconductor wafer in the diameter direction.

Figure 7:
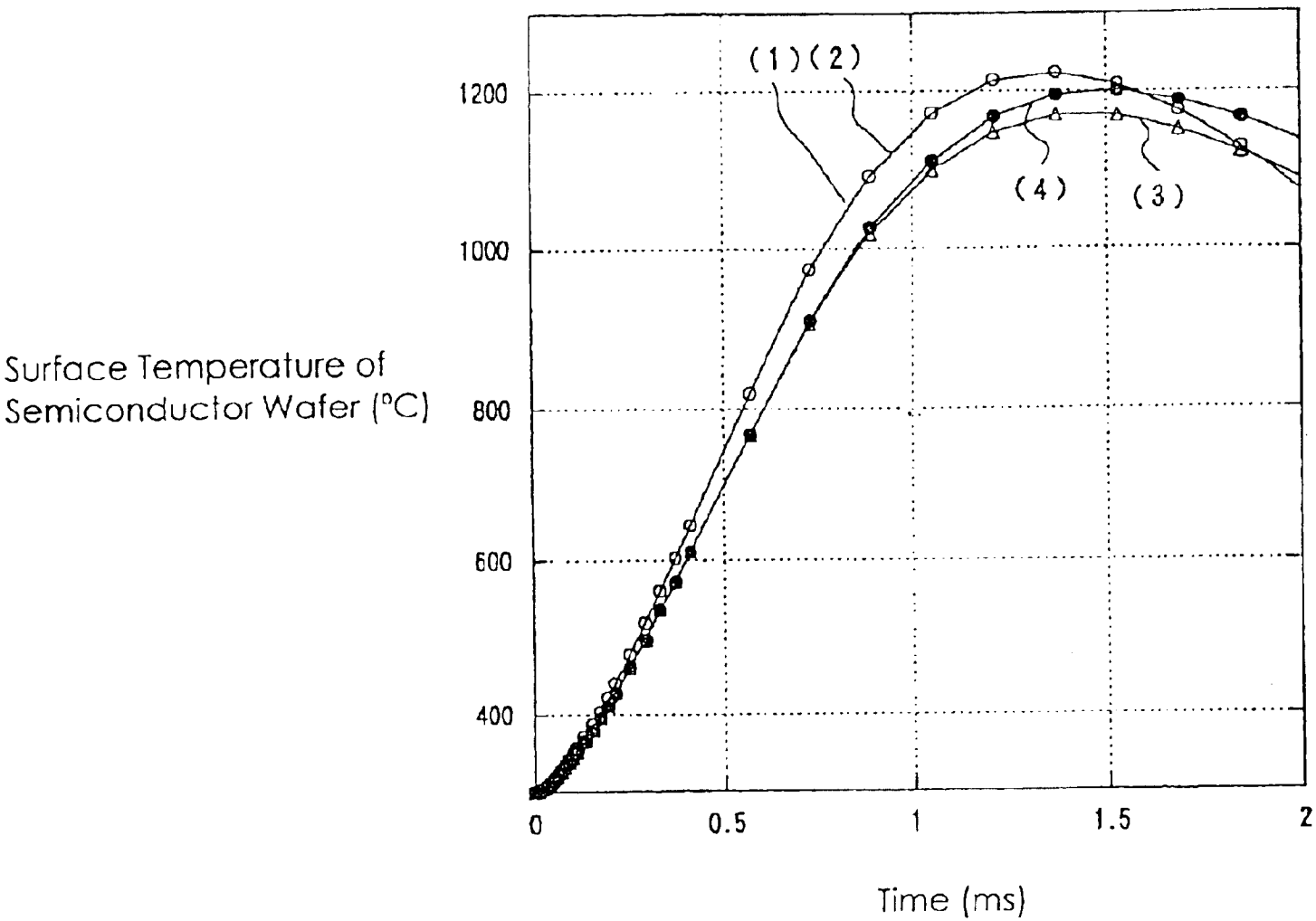
FIG. 7 is a graph showing a temperature change of a semiconductor wafer surface heated by the experimental radiant heating apparatus according to the second embodiment.

In the light turning-on conditions (1) to (4), change of a surface temperature on the portions of the semiconductor wafer that was used for measuring the light waveform was measured. The result is shown in FIG. 7. In FIG. 7, a curved line (1) showing the light turning-on condition (1) and a curve line (2) showing the light turning-on condition (2) completely overlap each other.

From these results, as shown in FIG. 6, by increasing voltage of the main condensers corresponding to the 6 side flash discharge lamps, it is possible to emit light with substantially the same waveform on the side(s) of semiconductor wafer in the standard light turning-on condition.

As shown in FIG. 7, by increasing voltage of the main condensers corresponding to the 6 side flash discharge lamps located on the side(s) of the semiconductor wafer, it was confirmed that the change of the surface temperature on both sides of the semiconductor wafer was approximately the same as that on the center portion of the semiconductor wafer in the standard light turning condition.

Description of further detail embodiment is given below.

EXAMPLE 1

In this Example, the radiant heating apparatus, as shown in FIG. 1, having flash emitting apparatus comprising twenty one (21) flash discharge lamps as a heat source was assembled, using the flash discharge lamp turning-on circuit shown in FIG. 2.

Each of flash discharge lamps used in this Example had a discharge container with a 10.5 mm outer diameter and an 8.5 inner diameter, and a trigger electrode having a 280 mm electrode distance, provided on an outer surface of the discharge container and made of a nickel wire with a 1.0 mm diameter. The twenty one (21) flash discharge lamps were selected from the same production lot. The main condensers were also selected from the same production lot.

In the radiant heating apparatus having such a structure, among the 21 flash discharge lamps, four (4) flash discharge lamps (two (2) flash discharge lamps located on each side) were used as side discharge flash lamps. A voltage to which the side main condensers corresponding to the side flash discharge lamps were charged, the capacity of the side main condensers, a voltage of the center main condensers, the capacity of the center main condenser was set to be 2750V, 1200 $\mu$F, 2500V, and 1200 $\mu$F respectively. In this embodiment, illumination distribution of the vicinity and surface of the 200 mm diameter semiconductor wafer was measured. The result is shown as curved line (a) in FIG. 8

The intensity of the light emitted on the center portion of the semiconductor wafer and the intensity of light emitted on the side portion(s) of the semiconductor wafer was measured. A distance between the center portion and the side portion was 100 mm. The ratio of the intensity of the light emitted on the center portion to that of light on the side portion is shown in Table 3

EXAMPLE 2

Figure 8:
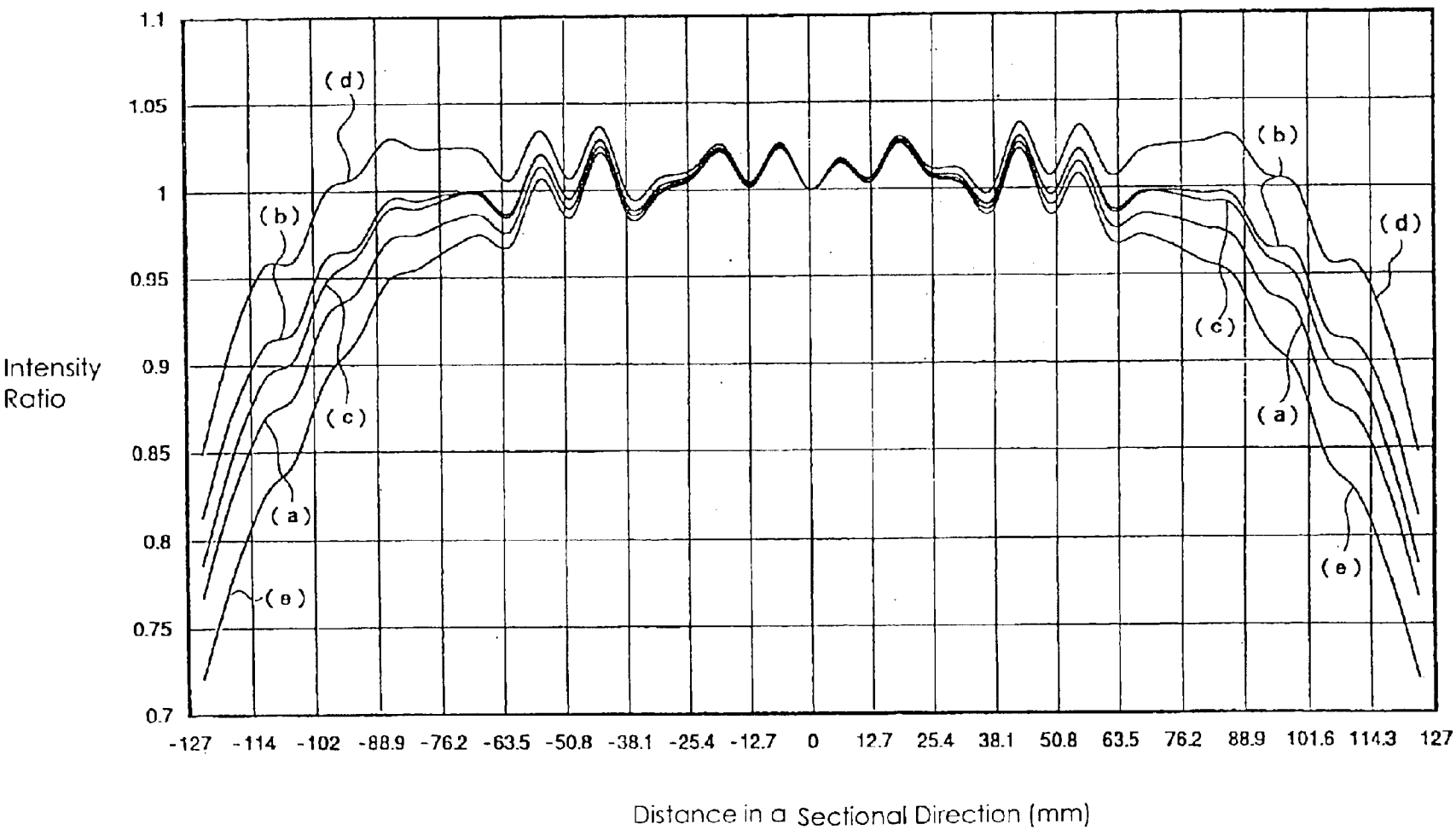
FIG. 8 is a graph showing illumination distribution on a semiconductor wafer and its vicinity in a sectional direction.

Except that voltage to which the side main condensers corresponding to the side flash discharge lamps were charged was set to be 3000V, the same radiant heating apparatus as that in the Example 1 was used to measure illumination distribution in the vicinity of the semiconductor wafer and the semiconductor wafer surface in the same manner as in Example 1. The result is shown in FIG. 8(*b*). Further, in the same manner as in Example 1, the ratio of the intensity of the light emitted on the side portion to the intensity of the light emitted on the center portion was obtained as shown in Table 3.

EXAMPLE 3

Except that the six (6) side flash discharge lamps instead of four (4) side flash discharge lamps (three (3) flash discharge lamps located on each side) among the twenty one (21) flash discharge lamps were used, in the Example 1, the same radiant heating apparatus as that in the Example 1 was used to measure illumination distribution in the vicinity of the semiconductor wafer and the semiconductor wafer surface in the same manner as in Example 1. The result is shown in FIG. 8(*c*). In the same manner as in Example 1, the ratio of the light intensity of the side portion to the light intensity on the center portion was obtained as shown in Table 3.

EXAMPLE 4

Except that six (6) side flash discharge lamps (three (3) flash discharge lamps located on each side) among the 21 flash discharge lamps were used and a voltage to which the side main condensers corresponding to the side flash discharge lamps were charged was 3000V, in the Example 4, the same radiant heating apparatus as that in the Example 1 was used to measure illumination distribution in the vicinity of the semiconductor wafers and the semiconductor wafer surface in the same manner as in the Example 1. The result is shown in FIG. 8(*d*). Further, in the same manner as in Example 1, the ratio of the intensity of the light emitted on the side portion to the intensity of the light emitted on the center portion was obtained as shown in Table 3.

COMPARATIVE EXAMPLE

Except that a voltage to which the side main condensers corresponding to the side flash discharge lamps were charged was 2500V, in the comparative example, the same radiant heating apparatus as that in the Example 1 was used to measure illumination distribution in the vicinity of the semiconductor wafers and the semiconductor wafer surface in the same manner as in the Example 1. The result is shown in FIG. 8(*e*). Further, in the same manner as in Example 1, the ratio of the intensity of light emitted on the side portion to the intensity of light emitted on the center portion was obtained as shown in Table 3.

TABLE 3

| | Ratio of the intensity |
|---|---|
| Example 1 | 0.927 |
| Example 2 | 0.961 |
| Example 3 | 0.947 |
| Example 4 | 0.999 |
| Comparative Example | 0.893 |

As described above, according to the Embodiments 1 to 4, it is confirmed that by using the radiant heating apparatus, the surface of the semiconductor wafer, that is workpiece, is heated with high uniformity.

Also it is possible to increase the number of flash discharge lamps, although the flash emitting device itself become large-sized whereby the radiant heating apparatus become large-sized.

According to the present invention, in the flash emitting device, the capacity of all the main condensers corresponding to the plurality of flash discharge lamps respectively is substantially the same.

Further, the voltage to which each of the side main condensers is charged is higher than any one of the center main condensers. Therefore, the full-width half maximum (FWHM) of the waveform of flash light emitted from each of the side flash discharge lamps agrees with the full-width half maximum (FWHM) of the waveform of flash light emitted from each of the center flash discharge lamps. Furthermore, a peak reaching time of the waveform of the flash light emitted from each of the side flash discharge flash lamps does not differ from that of the waveform of the flash light emitted from each of the center flash discharge lamps. ("peak reaching time" means a time period for light emitting energy to reach the peak energy level.)

Since the emitting light energy of the flash light emitted from each of the side flash discharge lamps is higher than that of the flash light emitted from each of the center flash discharge lamps, it is possible to make the intensity of light emitted on the side area of the workpiece substantially the same as that of light emitted on the center area of the workpiece.

The disclosure of Japanese Patent Application No. 2001-391406 filed on Dec. 25, 2001 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A flash emitting device having a plurality of flash discharge lamps arranged in parallel, in which a flash from the plurality of flash discharge lamps is emitted on a workpiece, the flash emitting device comprising:

a plurality of main condensers that supply light emitting energy, wherein each of the plurality of main condensers is connected to one of the plurality of flash discharge lamps, wherein at least one of the plurality of flash discharge lamps is a side flash discharge lamp located on a first side of the flash emitting device, the side flash discharge lamp emitting light having a higher intensity than light emitted by a plurality of flash discharge lamps located on a second side of the flash emitting device.

2. The flash emitting device according to claim 1, wherein the workpiece is at least one semiconductor wafer.

3. The flash emitting device according to claim 1, further comprising a chamber into which the workpiece is placed so that flash lights from at least one of the plurality of side flash discharge lamps and flash lights from at least one of the plurality of center flash discharge lamps are emitted on the workpiece.

4. The flash emitting device according to claim 3, the workpiece is at least one semiconductor wafer.

5. A flash emitting device in which a flash from a plurality of flash discharge lamps is emitted on a work piece, the flash emitting device comprising:

the plurality of flash discharge lamps arranged in parallel wherein at least one of the plurality of flash discharge lamps is a side flash discharge lamp located on a side of the flash emitting device and at least one of the plurality of flash discharge lamps is a center flash discharge lamp located on a center portion of the flash emitting device;

a plurality of side main condensers that supply light emitting energy, wherein each side main condenser is connected to one of the plurality of side flash discharge lamps;

a plurality of center main condensers that supply light emitting energy, wherein each center main condenser is connected to one of the plurality of center flash discharge lamps;

wherein a voltage supplied to each side main condenser is higher than the voltage supplied to each center main condenser.

6. The flash emitting device according to claim 2, wherein each side main condenser and each center main condenser have substantially the same capacity.

7. The flash emitting device according to claim 6, wherein the workpiece is at least one semiconductor wafer.

8. The flash emitting device according to claim 6, further comprising a chamber into which the workpiece is placed so that flash lights from at least one of the plurality of side flash discharge lamps and flash lights from at least one of the plurality of center flash discharge lamps are emitted on the workpiece.

9. The flash emitting device according to claim 8, wherein the workpiece is at least one semiconductor wafer.

10. The flash emitting device according to claim 5, further including a first direct current power source for supplying power to at least one of the plurality of center main condensers and a second direct current power source for supplying power to at least one of the plurality of side main condensers.

11. The flash emitting device according to claim 10, further comprising a chamber into which the workpiece is placed so that flash lights from at least one of the plurality of side flash discharge lamps and flash lights from at least one of the plurality of center flash discharge lamps are emitted on the workpiece.

12. The flash emitting device according to claim 11, wherein the workpiece is at least one semiconductor wafer.

13. The flash emitting device according to claim 10, wherein the workpiece is at least one semiconductor wafer.

14. The flash emitting device according to claim 5, further including a charge time controller that controls the voltage supplied to at least one the plurality of center main condensers by charging the at least one of the plurality of main condensers for a shorter time than a charging time of at least one of the plurality of side main condensers so that the voltage of the at least one of the plurality of center main condensers is lower than the voltage supplied to the at least one of the plurality of side main condensers.

15. The flash emitting device according to claim 14, further comprising a chamber into which the workpiece is placed so that flash lights from at least one of the plurality of side flash discharge lamps and flash lights from at least one of the plurality of center flash discharge lamps are emitted on the workpiece.

16. The flash emitting device according to claim 15, wherein the workpiece is at least one semiconductor wafer.

17. The flash emitting device according to claim 14, wherein the workpiece is at least one semiconductor wafer.

18. The flash emitting device according to claim 5, further including a charge time controller that controls the voltage of at least one of the plurality of side main condensers by charging at least one of the side main condensers longer than a charging time for at least one of the plurality of center main condensers so that the voltage of the at least one of the plurality of side main condensers is higher than the voltage of the at least one of the plurality of center main condensers.

19. The flash emitting device according to claim 18, further including a chamber into which the workpiece is placed so that flash lights from at least one of the plurality side flash discharge lamps and flash lights from at least one of the plurality of center flash discharge lamps are emitted on the workpiece.

20. The flash emitting device according to claim 19, wherein the workpiece is at least one semiconductor wafer.

21. The flash emitting device according to claim 18, wherein the workpiece is at least one semiconductor wafer.

22. The flash emitting device according to claim 5, further comprising a discharge controller that controls the voltage to at least one of the plurality of center main condensers by discharging a charges accumulated in the at least one of the plurality of center main condensers so that the voltage of the at least one of the plurality of center main condensers is lower than the voltage of the at least one of the plurality of side main condensers.

23. The flash emitting device according to claim 22, further including a chamber into which the workpiece is placed and flash lights from at least one of the plurality of side flash discharge lamps and flash lights from at least one of the plurality of center flash discharge lamps are emitted on the workpiece.

24. The flash emitting device according to claim 23, wherein the workpiece is at least one semiconductor wafer.

25. The flash emitting device according to claim 22, wherein the workpiece is at least one semiconductor wafer.

26. The flash emitting device according to claim 5, further comprising a chamber into which the workpiece is placed so that flash lights from at least one of the plurality of side flash discharge lamps and flash lights from at least one of the plurality of center flash discharge lamps are emitted on the workpiece.

27. The flash emitting device according to claim 26, wherein the workpiece is at least one semiconductor wafer.

28. The flash emitting device according to claim 26, wherein the workpiece is at least one semiconductor wafer.

29. The flash emitting device according to claim 5, wherein the workpiece is at least one semiconductor wafer.

30. A radiant heating apparatus comprising:

a flash emitting device having a plurality of flash discharge lamps arranged in parallel, in which a flash from the plurality of flash discharge lamps is emitted on a workpiece, the flash emitting device comprising:

a plurality of main condensers corresponding to the plurality of flash discharge lamps, wherein at least one of the plurality of flash discharge lamps is located on a first side of the flash emitting device and emits light with higher intensity than light emitted from another of the plurality of flash discharge lamps.

* * * * *